US011364645B1

(12) United States Patent
Richter et al.

(10) Patent No.: US 11,364,645 B1
(45) Date of Patent: Jun. 21, 2022

(54) ILLUMINATION OF FOLDING KNIVES FOR SAFE OPERATION IN THE DARK

(71) Applicant: MB-MICROTEC AG, Niederwangen (CH)

(72) Inventors: Karsten Richter, Bern (CH); Philipp Michel, Guemligen (CH); Peter Hug, Nidau (CH)

(73) Assignee: mb-microtec ag, Niederwangen (CH)

( * ) Notice: Subject to any disclaimer, the term of this patent is extended or adjusted under 35 U.S.C. 154(b) by 22 days.

(21) Appl. No.: 17/172,524

(22) Filed: Feb. 10, 2021

(51) Int. Cl.
*B26B 11/00* (2006.01)
*B26B 1/10* (2006.01)
*B26B 1/04* (2006.01)

(52) U.S. Cl.
CPC ..... *B26B 11/008* (2013.01); *B26B 1/04* (2013.01); *B26B 1/10* (2013.01)

(58) Field of Classification Search
CPC ..... B26B 1/02; B26B 11/008; B26B 1/044; B26B 1/04; B26B 1/10; F21V 33/0036; F21V 33/0084
See application file for complete search history.

(56) References Cited

U.S. PATENT DOCUMENTS 5,467,256 A * 11/1995 Chen ..... B26B 11/008 362/109
5,626,414 A * 5/1997 Chen ..... B26B 11/008 362/119
5,727,319 A * 3/1998 Myerchin ..... B26B 11/008 7/118
9,581,316 B2 2/2017 Karchon et al.
10,062,464 B2 8/2018 Karchon et al.
10,183,406 B2 1/2019 Karchon et al.
10,357,888 B2 7/2019 Karchon et al.
10,480,899 B1 11/2019 Karchon et al.
10,816,296 B2 10/2020 Karchon et al.
2009/0013581 A1* 1/2009 LoRocco ..... F41G 1/345 42/132
2012/0212939 A1* 8/2012 Brown ..... B26B 11/008 362/119
2014/0198485 A1* 7/2014 Karchon ..... G21F 5/015 264/0.5
2019/0321993 A1 10/2019 Karchon et al.
2019/0337168 A1* 11/2019 Mundhra ..... B26B 11/008

FOREIGN PATENT DOCUMENTS

DE 202017103241 U1 6/2017
GB 2394688 A * 5/2004 ..... B25F 1/04
SE 503625 C2 * 7/1996 ..... B26B 11/008

OTHER PUBLICATIONS

Cammenga BB X1 200 Tritium Beta Blade Fixed Knife Light, Newegg.com, Oct. 13, 2018 (7 pp.).
Victorinox Swiss Army Signature Lite Pocket Knife, Amazon.com, Mar. 19, 2009 (6 pp.).

* cited by examiner

*Primary Examiner* — Jennifer S Matthews
(74) *Attorney, Agent, or Firm* — FisherBroyles, LLP

(57) ABSTRACT

A folding knife and related method include actuating elements for locking or unlocking the blade of the knife. The actuating elements are permanently illuminated or backlit so that the actuating elements are more clearly visible in low light conditions and can therefore be safely operated. Such features for knife applications may provide advantages for particular activities where knives are commonly used, such as for law enforcement and hunting.

15 Claims, 11 Drawing Sheets

ILLUMINATION OF FOLDING KNIVES FOR SAFE OPERATION IN THE DARK

TECHNICAL FIELD

The present disclosure relates generally to folding knives, and more particularly to providing illumination features in actuatable and other features of folding knives.

BACKGROUND

There are many types of knives for a wide variety of uses. In the tactical and outdoor areas, folding knives with locks are typically preferred. These types of knives are generally compact, and the blade is protected during transport and lockable during use.

A frequent request of the above-mentioned target group is lighting of the knife for use in low light conditions such as in the dark or at night, which may ensure more safe operation of the blade.

The use of lighting on folding knives is relatively rare. However, there are pocketknives that include LEDs as a light source for illuminating objects besides the pocketknife itself. Other pocketknives exist that use phosphorescent paint on the outside of the handle of the knife. Other pocketknives include a thumb button on the blade, and this thumb button is illuminated with as Gaseous Tritium Light Source (GTLS). Another example includes a switch button in the pocketknife that operates to lock the blade, but the switch button merely covers one of the two differently colored GTLS positioned on the handle depending on the position of the switch button. Another example knife is used as a transport box for the safe transport of GTLS. Other fixed blade type knives include GTLS in for a variety of purposes.

Opportunities exist for improvements in knives to address safe handling of common folding knife types (e.g., backlock and liner lock knives) in low light conditions, in order to reduce the risk of injury when operating the blade of the knife.

SUMMARY

The present disclosure provides knife examples in which the actuating elements for locking or unlocking the blade of the knife and/or blade stop features of knife are permanently illuminated or backlit so that features of the knife are more clearly visible in low light conditions and can therefore the knife can be safely operated. Such features for knife applications may provide advantages for particular activities where knives are commonly used, such as for law enforcement and hunting. In some examples, a feature adjacent to the actuating member may be illuminated with a permanent lighting feature, and the actuating member may have a cutout or breakthrough feature that provides visibility of the permanent lighting feature through the actuating member.

In addition to the lighting of the actuating elements, other features are disclosed that indicate whether the blade is locked and thus secured for use without the blade unintentionally folding back into the handle. Such features may include a blade stop feature of the knife that the blade contacts with in a fully open position.

Generally, the permanent lighting features disclosed herein are used on a knife in order for the knife to be seen in low light condition, not for the lighting feature to illuminate other objects besides the knife, or to even illuminate the features of the knife. The permanent light feature itself is intended to be visible by a user in order for the user to identify the location of the knife in low light conditions, or to identify certain features of the knife to be actuated as part of operating the knife or to indicate the blade of the knife in certain actuated positions when the light is or is not visible. In at least some embodiments, the permanent light or multiple permanent lights used on the knife may make the location of the knife or its components or knife functions visible in low light condition when the knife is in a variety of positions (i.e., the knife is laying on either of its sides or on an end surface, etc.).

Part of the fulfillment of the safety criteria for knives that is disclosed herein is that the lighting should be made strong enough that the actuating elements can be seen and found, but that it lights up continuously and does not have to be switched on. There can be advantages for a user if the light source is independent of an additional energy source (e.g., a battery) and is therefore not suddenly unavailable during safety-relevant use in low light conditions such as the dark.

For these types of lighting applications, a permanent lighting technology such as Gaseous Tritium Light Source (GTLS), which may be marketed under the brand name Trigalight®, may be particularly useful. GLTS may also be used in other security-relevant applications such as night sight (e.g., iron sights) or tactical watches. For tactical watches, a relevant stipulation for military use is outlined in MIL-PRF-46374G, which requires that after 8 hours of storage in the dark, the time of day displayed by the watch can be read without any further action of the user.

The present disclosure details solutions that are intended to be economical and technically feasible related to the safe handling of folding knives by integrating GTLS permanent light technology in knives of many different types, such as the backlock and liner lock knives mentioned above.

One aspect of the present disclosure further relates to a folding knife that includes a handle assembly, a blade pivotally connected to the handle assembly, at least one of a liner lock or backlock member actuatable to lock and unlock the blade relative to the handle assembly, or a blade stop member, and at least one Gaseous Tritium Light Source (GTLS) source carried by the liner lock or backlock member. The at least one GTLS is positioned adjacent to the liner lock or backlock member, or carried by the blade stop member.

The at least one GTLS may be attached to an actuating portion of the liner lock or backlock member. The at least one GTLS may be carried by the liner lock or backlock member or positioned adjacent to the liner lock or backlock member, and another GTLS is carried by the blade stop member. The liner lock member may be a liner lock lever, and the at least one GTLS may be attached to an actuation portion of the liner lock lever. The at least one GTLS may be positioned adjacent to the liner lock or backlock member. The backlock member may include a backlock lever, and the at least one GTLS may be attached to an actuation portion of the backlock lever. The at least one GTLS may be positioned in a recess formed in the liner lock or backstop member, or in a recess formed in the blade stop member. The at least one GTLS may be visible from at least two sides of the knife. The recess may be designed as a groove, a pass through bore, a breakthrough, or a cavity. The folding knife may also include a breakthrough formed in the liner lock, the at least one GTLS may be positioned adjacent to the liner lock, and the at least one GTLS may be visible through the breakthrough. The at least one GTLS may be secured directly to or is part of a GTLS assembly that is secured to the liner lock or backlock member or the blade stop member. The at least one GTLS may be part of a GTLS assembly that includes a transparent or partially transparent container, and the transparent or partially transparent container may include at least one transparent solid component such as sapphire, glass, or plastic in any shape.

Another aspect of the present disclosure relates to a folding knife that includes a blade pivotal between opened and closed positions, an actuating element arranged to lock the blade in the open position and be actuated to permit the blade to move into the closed position, and at least one Gaseous Tritium Light Source (GTLS) source carried by the actuating element or positioned adjacent to the actuating element.

The actuating element may be a backlock or liner lock member. The at least one GTLS may be attached to an actuating portion of the backlock or liner lock member. The folding knife may also include a blade stop, and the at least one GTLS may include a first GTLS carried by the actuating element and a second GTLS carried by the blade stop. The folding knife may include a recess positioned in the actuating element or adjacent to the actuating element, the recess may be visible from at least one side of the knife, and the at least one GTLS may be positioned in the recess.

A further aspect of the present disclosure relates to a method of manufacturing a folding knife. The method includes providing a handle assembly, a blade, at least one Gaseous Tritium Light Source (GTLS), and at least one of a liner lock or backlock member or a blade stop. The method also includes pivotally connecting the blade to the handle assembly, mounting the at least one of the liner lock or backlock member or the blade stop to the handle, and mounting the at least one GTLS to or adjacent to the at least one of the liner lock or backlock member or the blade stop.

The backlock or liner lock member may include a backlock lever or liner lock lever, and the at least one GTLS may be mounted to or adjacent to an actuation portion of the backlock lever or liner lock lever. Mounting the at least one GTLS may include covering the at least one GTLS with a protective covering.

BRIEF DESCRIPTION OF THE DRAWINGS

The accompanying drawings and figures illustrate a number of exemplary embodiments and are part of the specification. Together with the present description, these drawings demonstrate and explain various principles of this disclosure. A further understanding of the nature and advantages of the present invention may be realized by reference to the following drawings. In the appended figures, similar components or features may have the same reference label.

Figure 1:
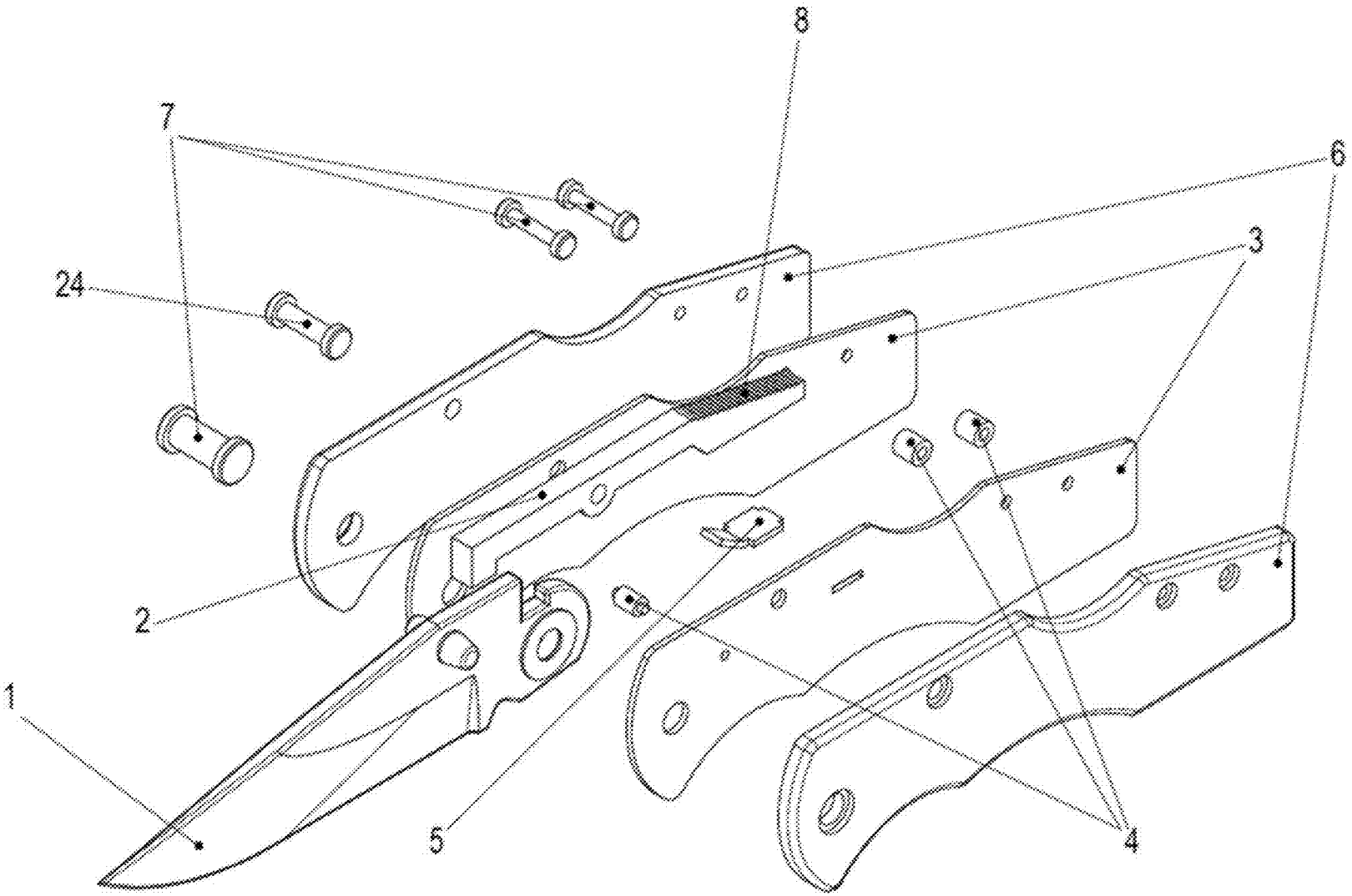
FIG. 1 is an exploded perspective view of a folding knife with a backlock in accordance with the present disclosure.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

This description provides examples, and is not intended to limit the scope, applicability or configuration of the invention. Rather, the ensuing description will provide those skilled in the art with an enabling description for implementing embodiments of the invention. Various changes may be made in the function and arrangement of elements.

Thus, various embodiments may omit, substitute, or add various procedures or components as appropriate. For instance, it should be appreciated that the methods may be performed in an order different than that described, and that various steps may be added, omitted or combined. Also, aspects and elements described with respect to certain embodiments may be combined in various other embodiments. It should also be appreciated that the following systems, methods, and devices may individually or collectively be components of a larger system, wherein other procedures may take precedence over or otherwise modify their application.

The detailed description of exemplary embodiments herein makes reference to the accompanying drawings, which show exemplary embodiments by way of illustration. While these exemplary embodiments are described in sufficient detail to enable those skilled in the art to practice the disclosure, it should be understood that other embodiments may be realized and that logical changes and adaptations in design and construction may be made in accordance with this disclosure and the teachings herein without departing from the spirit and scope of the disclosure. Thus, the detailed description herein is presented for purposes of illustration only and not of limitation.

In various embodiments, with reference to the accompanying figures, the present disclosure generally is directed to knives having illumination features. More particularly, the present disclosure is directed to folding knives having illumination features. The illumination features may include gaseous tritium light sources (GTLS). The GTLS may be positioned on or carried by various features of the folding knife, such as, for example, a backlock feature, liner lock feature, or other actuating or locking feature of the folding knife. In at least some arrangements, the GTLS or other illumination may be provided on an actuation feature of the folding knife to provide improved visualization of the actuation feature by a user for improved safe operation of the folding knife in low light environments.

The GTLS may also be positioned such that the GTLS may be visible when the blade of the knife is in a position that is less than a fully opened position, and the GTLS is covered from view when the blade is in the fully open position. A single folding knife may include multiple GTLS positioned at various locations to provide different visualization functions related to operation of the folding knife (i.e., locking and/or unlocking the blade, and/or detecting an open or closed position of the blade).

FIG. 1 shows a folding knife embodiment having a backlock mechanism 2. The backlock mechanism 2 may include one or more backlock members and may be referred to as a backlock or backlock member. The folding knife is shown in an exploded perspective view. The folding knife includes two side plates 3 (also referred to as liners 3), which are separated by one another by one or more spacer elements 4. The least two further elements, the blade 1 and the backlock 2, are arranged between the side plates or liners 3. The backlock 2 is designed or arranged in such a way that it is not clamped by the side plates 3 and can be moved in a rotating manner around a pivot access of the backlock 24.

The folding knife of FIG. 1 may also include a spring element 5 arranged to apply a biasing force to the backlock 2. The spring element 5 may be designed as an independent component from other components of the folding knife, or may be integrated into other components, such as, for example, one of the side plates 3. Depending on the design of the folding knife, there may be other components positioned between the side plates 3.

The backlock 2 may include an actuation portion 8, which when actuated by a user unlocks the blade 1. The actuation portion 8 may include markings, for example, a differentiating surface finish. The side plates 3 may have a recess formed along a top edge thereof in the area of the actuation portion 8 of the backlock 2 to provide improved access to the actuation portion 8. Pressing on the actuation portion 8 may apply a rotation force or moment force to the backlock 2 that moves an opposite end of the backlock 2 away from the blade 1. Moving the opposite end of the backlock 2 may provide engagement or disengagement with the blade 1 to provide locking and/or unlocking of the blade when the blade is in the open and/or closed position.

The folding knife of FIG. 1 may include handle features 6 positioned outside of the side plates 3. The handles 6 may be optional. In at least some arrangements, when the handles 6 are not included in the folding knife, the side plates 3 may function as handle features for the folding knife in that the user may grip the side plates as part of operating the folding knife. The components of the folding knife of FIG. 1 may be held together by connecting elements 7. The connecting element 7 may be any of a variety of fasteners such as screws or rivets. The connecting element 7 may extend through components of the folding knife such as, for example, the handles 6 and side plates 3. One of the fasteners may provide a pivot axis or pivot point for the backlock 2.

Figure 2:
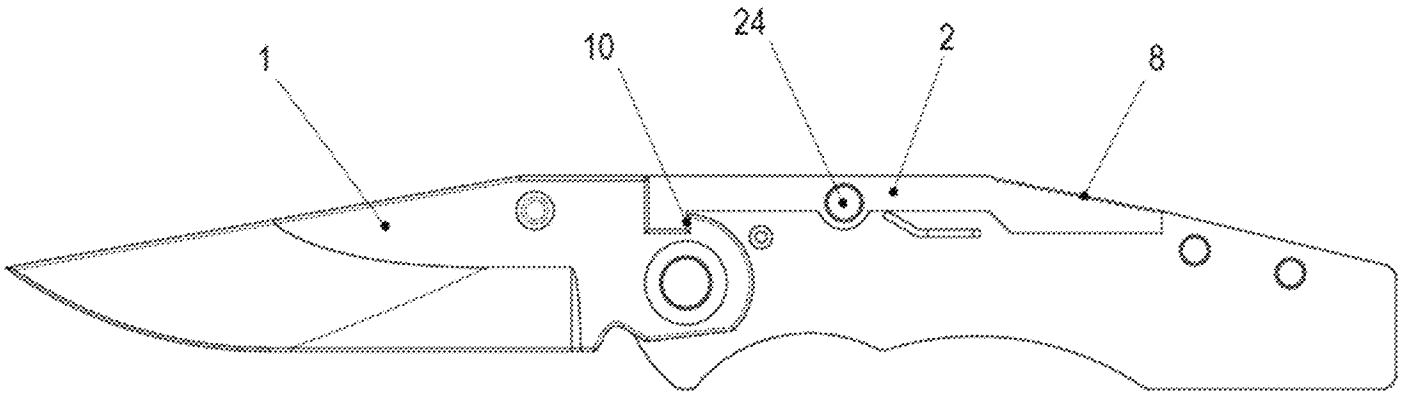
FIG. 2 is a side view of backlock and other features of the folding knife of FIG. 1 assembled together.

FIG. 2 shows some of the components of the folding knife of FIG. 1 in an assembled arrangement with the blade 1 in a fully opened and locked position relative to one of the side plates 3 and the backlock 2. FIG. 2 shows the backlock 2 having a backlock mechanism 10 at an end thereof opposite the actuation portion 8. To lock the blade 1, a cam or backlock mechanism 10 on the backlock 2 engages in a groove or other locking feature formed on the blade 1. The groove in the blade 1 is typically positioned adjacent to an attachment point of the blade 1 to the side plate 3. When the backlock 2 is actuated by pressing on the actuation portion 8, the blade 1 is unlocked by rotating the backlock 2 about a pivot axis 24 defined by one of the connecting elements 7 that extends through the backlock 2. Once the blade 1 is unlocked or disconnected from the backlock mechanism 10, the blade is able to rotate from the fully opened position shown in FIG. 2 to a partially closed or fully closed position relative to the side plate 3.

Actuating the actuation portion 8 moves the backlock 2 against the biasing force applied by spring element 5. Thus, releasing the force applied to the actuation portion 8 results in the backlock 2 rotating back into the rest position shown in FIG. 2 due to the biasing force applied by spring element 5. Thus, the backlock 2 is biased into a locked position with the blade 1 to maintain the blade in the fully open position until an actuation force is applied to the actuation portion 8.

Figure 3:
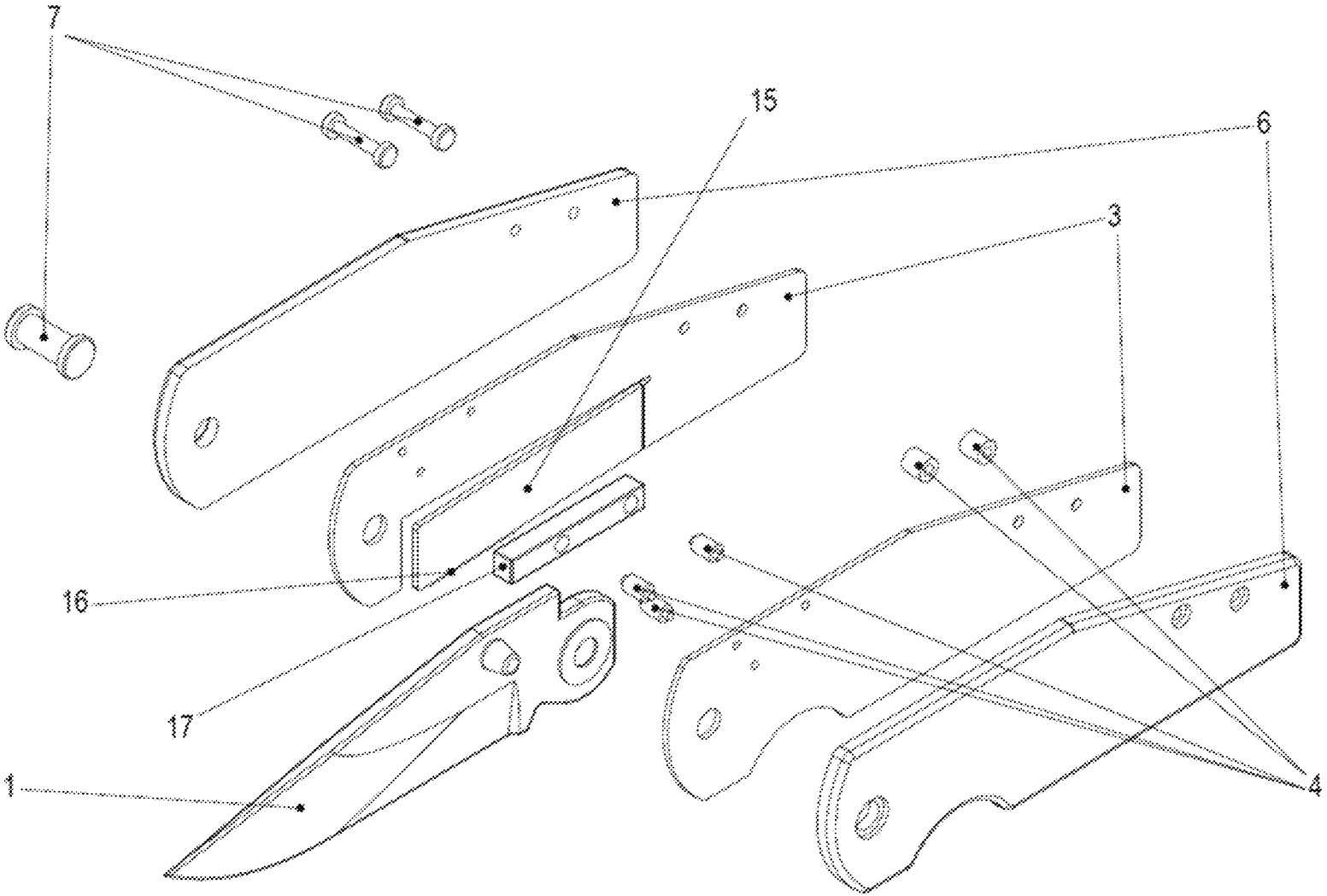
FIG. 3 is an exploded perspective view of a folding knife with a liner lock in accordance with the present disclosure.

FIG. 3 shows another example folding knife that includes a liner lock mechanism 15 that retains the blade in locked and/or unlocked or open and/or closed positions. The liner lock mechanism 15 may include one or more liner lock members and may be referred to as a liner lock or a liner lock member. The liner lock mechanism 15 may be used in place of the backlock mechanism 2 from the embodiment of FIGS. 1 and 2. FIG. 3 shows the folding knife having two side plates 3, which are separated from one another by one or more spacer elements 4. At least two further elements, the blade 1 and a blade stop 17, are arranged between the side plates 3. The blade stop 17 may be designed as an independent component from the remaining components of the folding knife, or may be integrated into one or more of the other components. Depending on the design of the folding knife, there may be other components positioned between the side plates 3.

The folding knife includes a liner lock 15, which may also be referred to as a side spring 15. The liner lock 15 may be integrally formed as a single piece with one of the side plates 3. For example, the liner lock 15 may be integrated in the form of a resilient tab in one of the side plates 3. In another example, the liner lock 15 may be arranged as an independent component positioned between the side plates 3.

The liner lock 15 is typically, but not necessarily, biased into the space defined between the side plates 3 such that a free end of the liner lock 15 engages a portion of the blade 1 to provide a locking of the blade 1 in the opened and/or closed position. A portion 16 of the free end of the liner lock 15 may be exposed for engagement by a user. This portion 16 is typically exposed along a bottom side of the folding knife in the orientation shown in FIG. 3. A user may press the portion 16 in a lateral, side-to-side direction to provide unlocking of the blade. The portion 16 may include differentiating surface finish to indicate visually and tactilely the portion 16 can actuated for unlocking the blade 1.

Often, although not necessarily, additional handles 6 are positioned on outside surfaces of the side plates 3. In at least some examples, the folding knife does not include separate handles 6, but rather the side plates 3 provide a handle function for the folding knife. The individual knife components may be held together by connecting elements 7. The connecting element 7 may include a variety of different fasteners such as, for example, screws or rivets. The connecting element 7 may extend through the side plates 3 and handles 6, and other components of the knife. One of the connecting elements 7 may provide a pivot connection of the blade 1 to the side plates 3 and handles 6.

Figure 4:
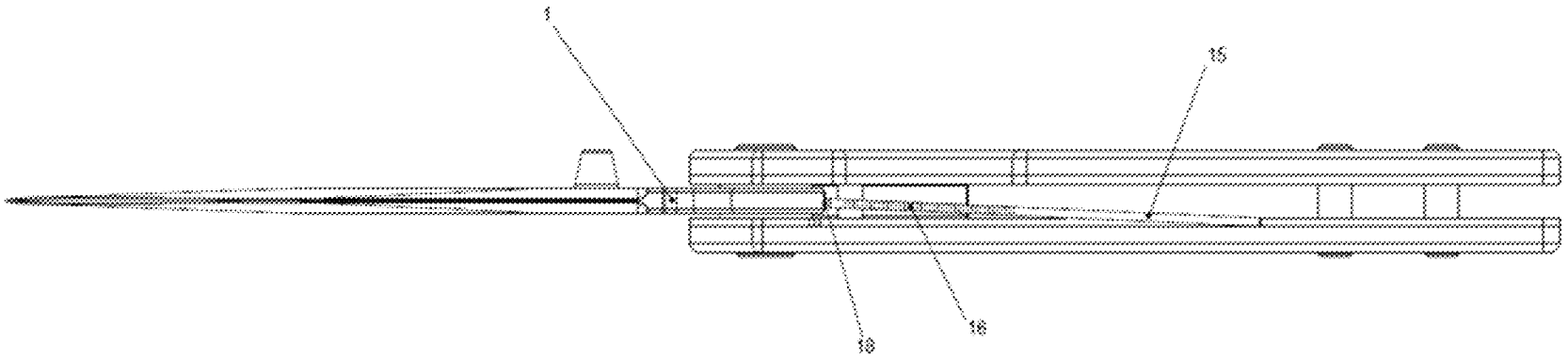
FIG. 4 is a bottom view of the folding knife shown in FIG. 3 assembled together and illustrating the liner lock.

FIG. 4 shows the folding knife of FIG. 3 in an assembled arrangement and from a bottom view. The liner lock 15 includes a liner lock mechanism 18 that engages with a groove or recess formed in the blade 1, thus preventing the blade 1 from rotating from the fully open position shown in FIG. 4 towards a closed position. By actuating the liner lock 15 at the actuating portion 16, the rotary movement of the blade is released and the blade can be folded in from a fully open position shown in FIG. 4 towards a closed position within the side plates 3. The liner lock 15 is biased into the space defined between the side plates 3 such that the liner lock 15 maintains the locked position of the blade 1 in the fully opened position until a user intentionally applies a force to the actuating portion 16 that moves the liner lock mechanism 18 out of engagement with the blade 1. When the user releases the actuating force applied to actuating portion 16, the liner lock can move back into the space defined between the side plates 3, thereby being in position to again lock the blade 1 when the blade returns into the fully opened position.

For each of the folding knives shown in FIG. 1-4, various illumination features may be integrated into the components of the folding knives. For example, illumination features may be arranged in restricted installation spaces for illuminating actuating elements and/or to provide visualization of a blade stop. The illumination features may assist with providing improved safety and handling of the knife. The illumination features and related advantages are described in further detail below with reference to FIGS. 5-11.

There may be several ways of a user getting injured when operating a folding knife in low light conditions such as the dark or nighttime conditions. After using the knife, with the blade in a fully opened position, the blade may be returned to a safely stowed position in the knife handle by unlocking the blade. To stow away the blade 1 in the folding knives of FIGS. 1-4, the actuating element for releasing the blade must be operated quickly and safely in the low light conditions. If the actuation cannot be accomplished, there is a risk of injury to the user when folding the blade back into the stowed position. Another possibility for injury may be the use of the knife without the blade being locked in the open position, and thus the blade is able to collapse during use when the user thought the blade was in a locked and fully opened position.

Figure 5:
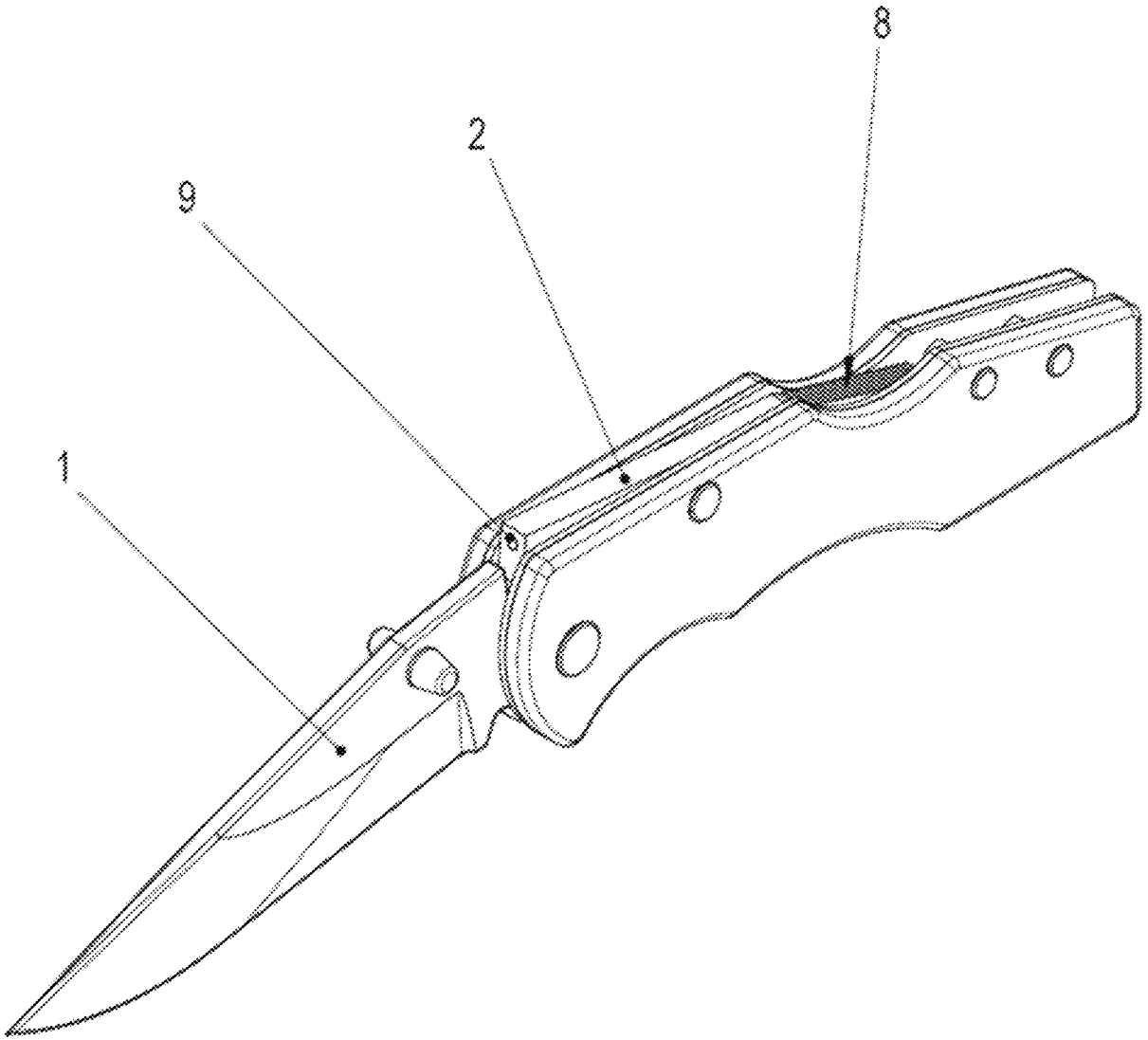
FIG. 5 is a perspective view of the folding knife shown in FIG. 1 in an assembled arrangement with the blade not fully opened or locked.

Referring to FIG. 5, the folding knife of FIGS. 1 and 2 is shown in an assembled arrangement and including a GTLS 9 positioned in the backlock 2 at the blade stop end and facing towards the blade. This arrangement for the GTLS makes it possible for the user to see the GTLS when the blade is in any rotated position except for the fully opened position. FIG. 5 shows the blade in a partially open position such that the GTLS 9 is visible. Thus, if the GTLS 9 is still partially visible in the blade stop end of the back stop 2, the blade 1 is known by the user to not be fully locked in the open position. If the blade 1 is completely locked as shown in FIG. 6, the GTLS 9 is no longer visible at the end of the backlock 2.

Figure 7:
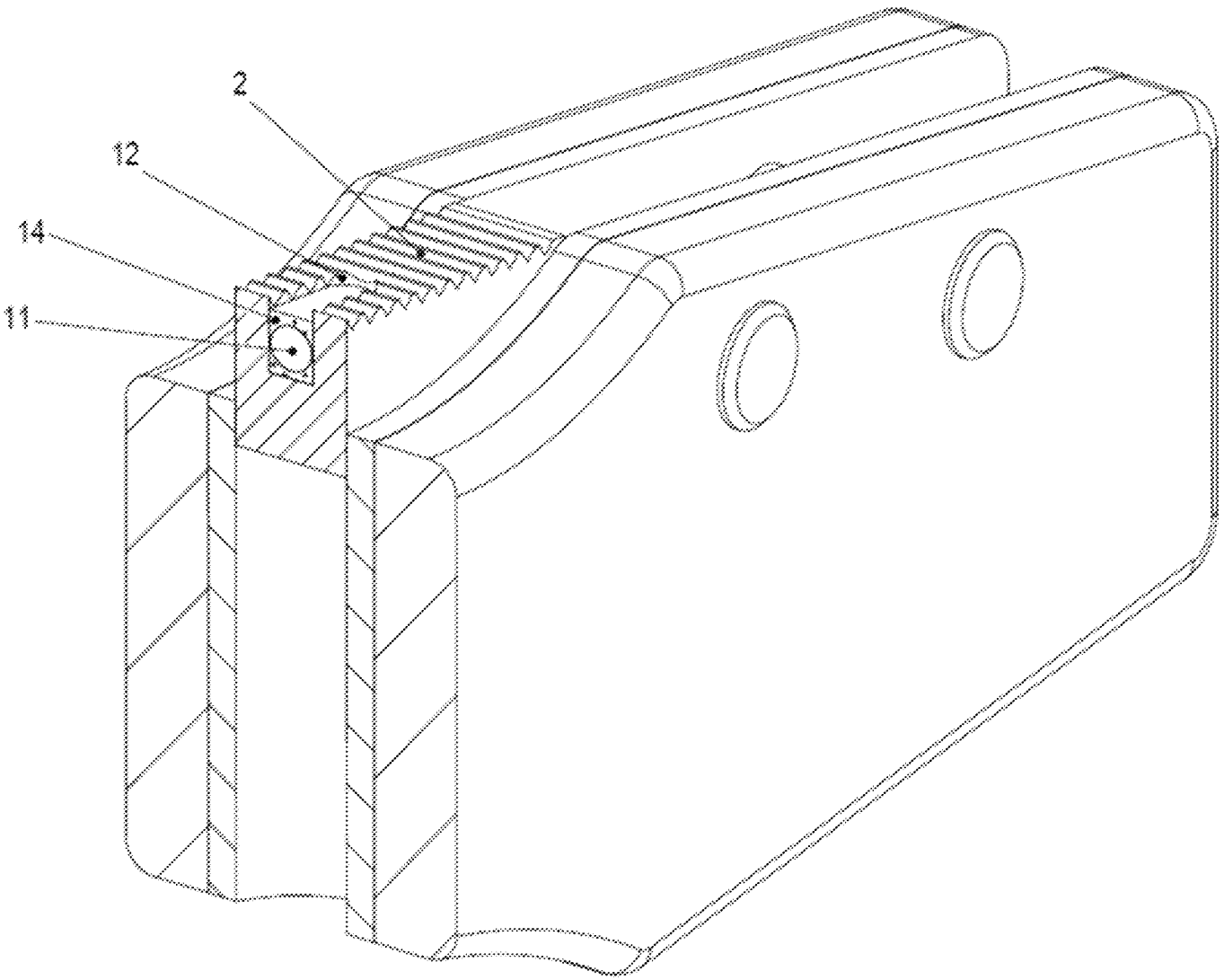
FIG. 7 is a cross-sectional view of the folding knife of FIG. 6 having a GTLS positioned in a recess at an actuation portion of the backlock.

For the backlock design of FIGS. 1, 2 and 5, there is typically a recess formed along the handles 6 and side plates 3 such that the actuation portion 8 of the backlock 2 is visible and accessible for operation by the user. However, in low light conditions, it may be difficult to identify and locate the actuation portion 8. A GTLS 11 may be integrated into the backlock 2 in the area of the actuation portion 6 as shown in FIG. 7. One or more GTLS 11 may be integrated into the actuation portion 8. In some arrangements, a single GTLS 11 may be positioned in a recess that is formed along one side surface of the actuation portion 8 such that the GTLS 11 is visible on only one side of the folding knife. FIG. 7 shows the recess 12 formed along a top surface of the actuation portion 8, the GTLS 11 positioned within the recess 12, and a protective layer 14 provided across a top surface of the GTLS 11. In at least one example, the protective layer 14 may also provide a connection between the GTLS 11 and the backlock 2. The protective layer 14 may be, in at least one example, an adhesive. The protective layer 14 may comprise a translucent or a transparent material that permits light emitted by GTLS 11 to be visible to the user. Other examples may include multiple GTLS positioned within a single recess 12, or a plurality of recesses 12 positioned along a single surface of the backlock 2 (e.g., along the top surface as shown in FIG. 7) with one or more separate GTLS positioned at each of the recesses.

Figure 6:
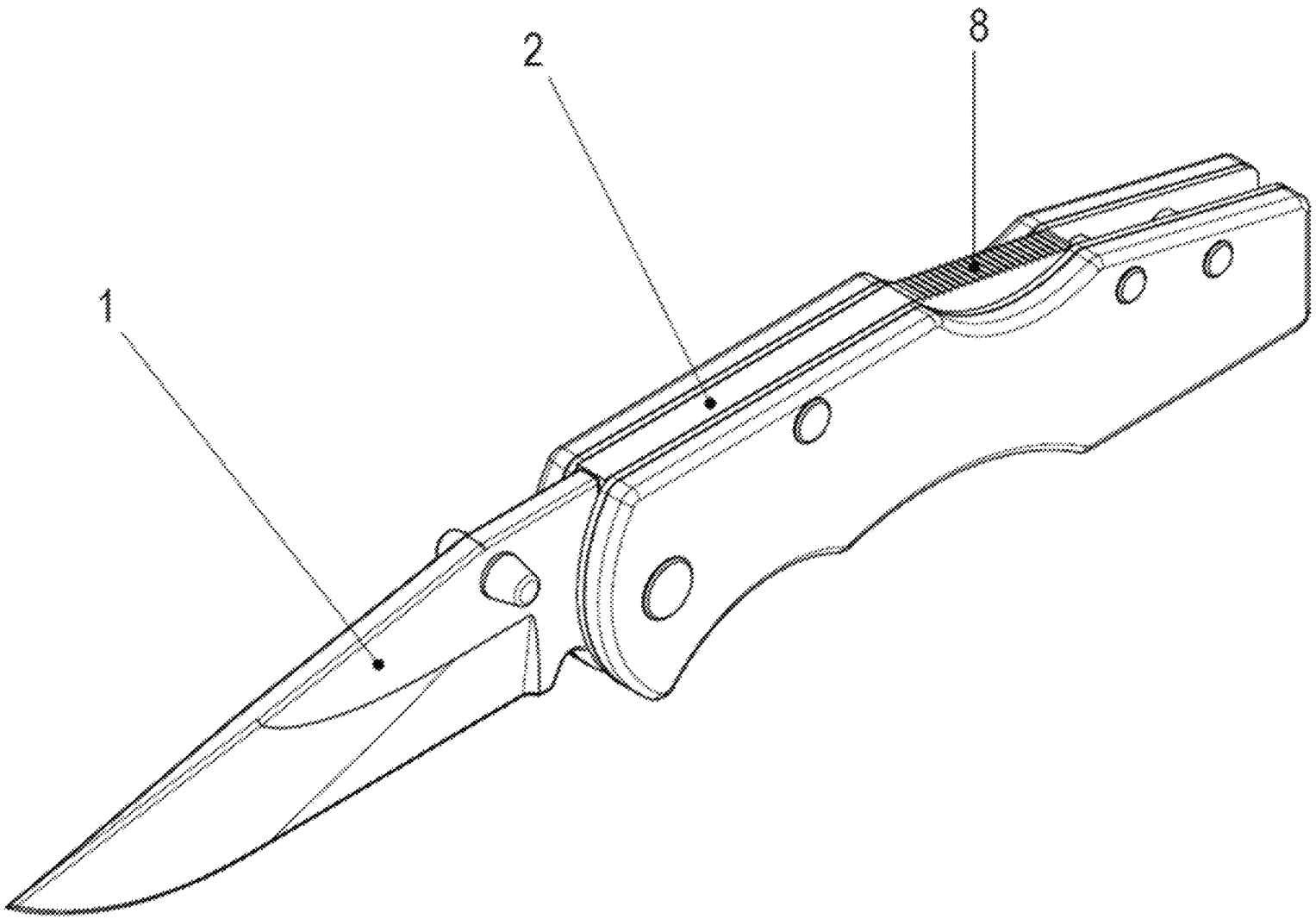
FIG. 6 is a perspective view of the folding knife in FIG. 1 in an assembled arrangement with the backlock and the blade in a fully locked position.
Figure 8:
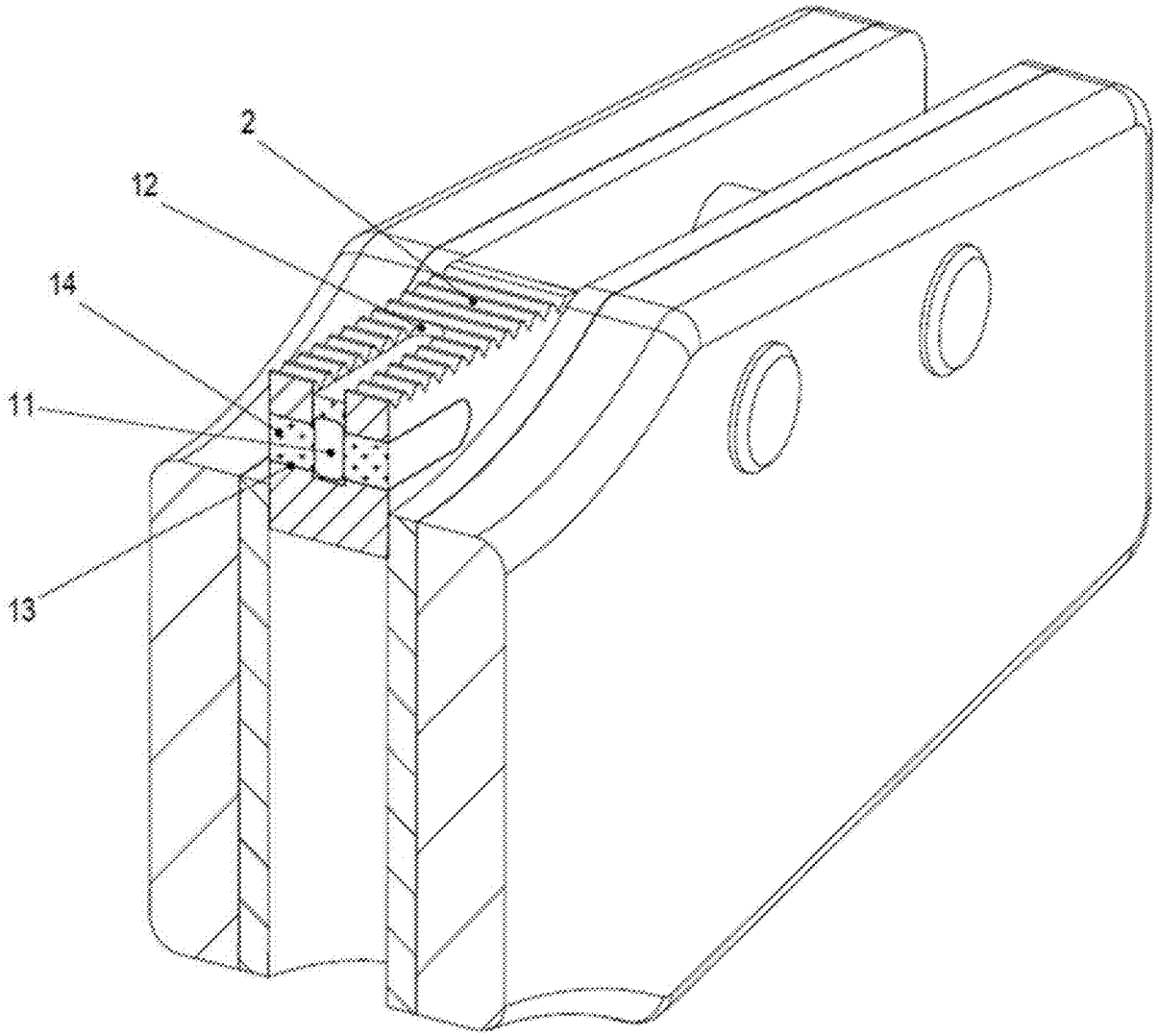
FIG. 8 is a cross-sectional view of the folding knife of FIG. 6 with a GTLS in a recess at an actuation portion of the backlock and an additional breakthrough provided in the backlock for visibility of the GTLS from at least two sides of the backlock.

FIG. 8 shows another arrangement for the folding knife of FIGS. 5 and 6 wherein a breakthrough 13 is formed in the backlock 2 to provide visualization of the GTLS 11 from two or more surfaces of the backlock 2 and/or two or more sides of the folding knife. The embodiment of FIG. 8 shows a single recess 12 with a GTLS 11 positioned therein, and a protective layer 14 provided within the recess 12 and the breakthrough 13. The protective layer may comprise a translucent or transparent material that permits light from the GTLS to be visible through at least the opposing side surfaces of the backlock 2 through the breakthrough 13. The GTLS 11 may also be visible along the top surface of the backlock 2 through the top of the recess 12. Other embodiments may include multiple recesses 12 with one or more separate GTLS positioned in each of the recesses 12. A separate breakthrough 13 may be provided for each of the recesses 12, or a single breakthrough 13 may be provided for two or more of the recesses 12. A separate GTLS may be provided for each of the recesses and/or breakthroughs, or multiple GTLS's may be positioned within a single recess and/or associated with one or more of the breakthroughs 13.

Figure 9:
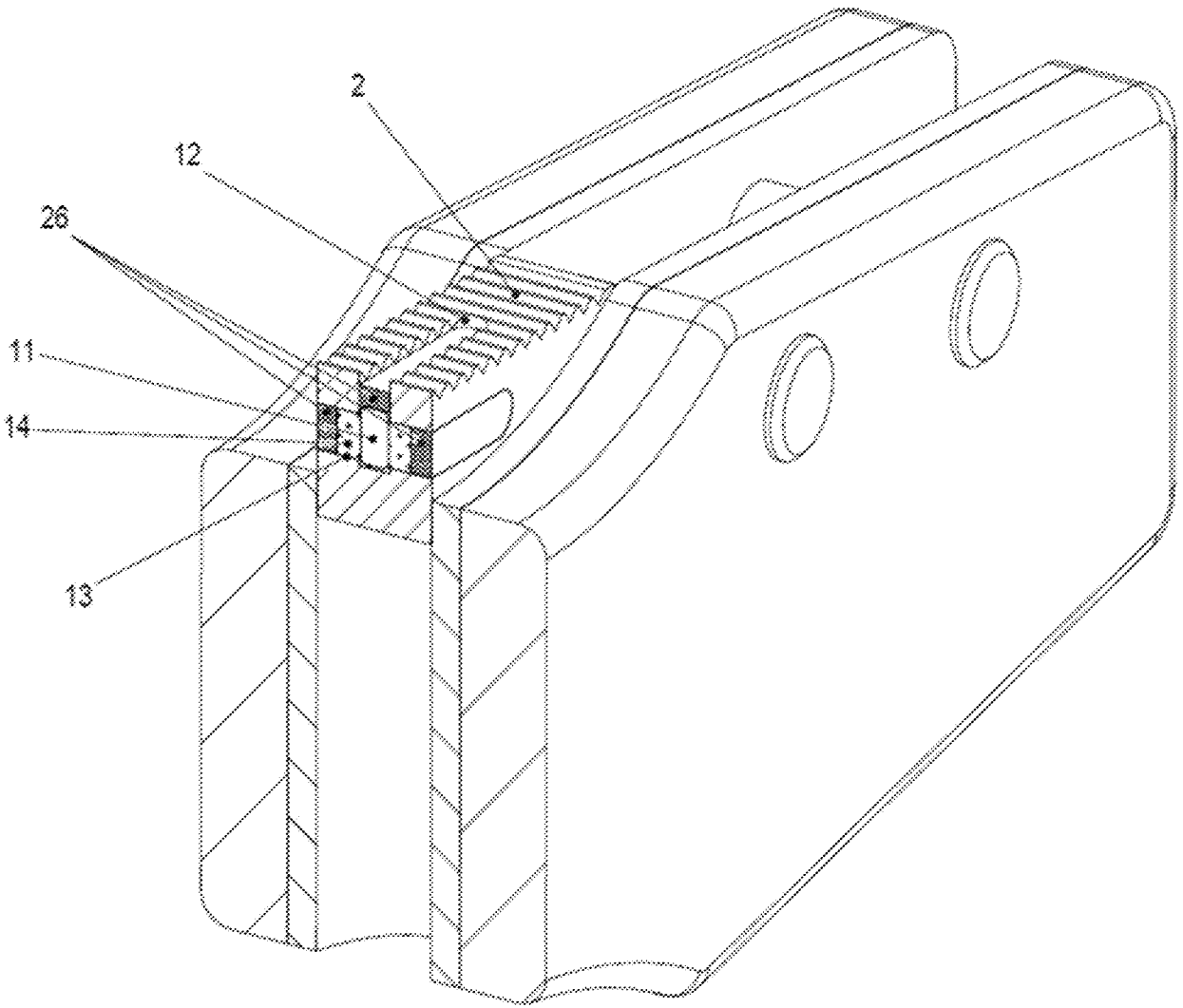
FIG. 9 is a cross-sectional view of the folding knife of FIG. 6 having a GTLS in a recess of the backlock at an actuation position of the backlock with an additional breakthrough provided for visibility of the GTLS and a hard cover protection provided over the GTLS.

The GTLS 11 may have a contoured (e.g., round) or flat configuration. Each GTLS 11 may be retained using an adhesive that serves as the protective layer 14. Other types of connection features may be used to secure the GTLS within the recess 12. The connection feature may be separate from the protective layer 14. Alternatively, as shown in FIG. 9, additional protective covers 26 may be used to cover, protect, and/or secure the GTLS 11 within the recess 12. The protective covers 26 may comprise a transparent material. Some example materials that may be used for the protective cover 26 may include plastic, glass, or sapphire. The protective cover 26 may be used in combination with the protective layer 14 or independent and separate of the protective layer 14. FIG. 9 shows a combination of protective layer 14 being used with one or more protective covers 26 within the recess 12 and breakthrough 13. The protective cover 26 may be used in other embodiments, such as embodiments that do not include a breakthrough 13, or embodiments that include only a breakthrough 13 without a separate recess 12 and the GTLS 11 is positioned within the breakthrough 13.

Figure 10:
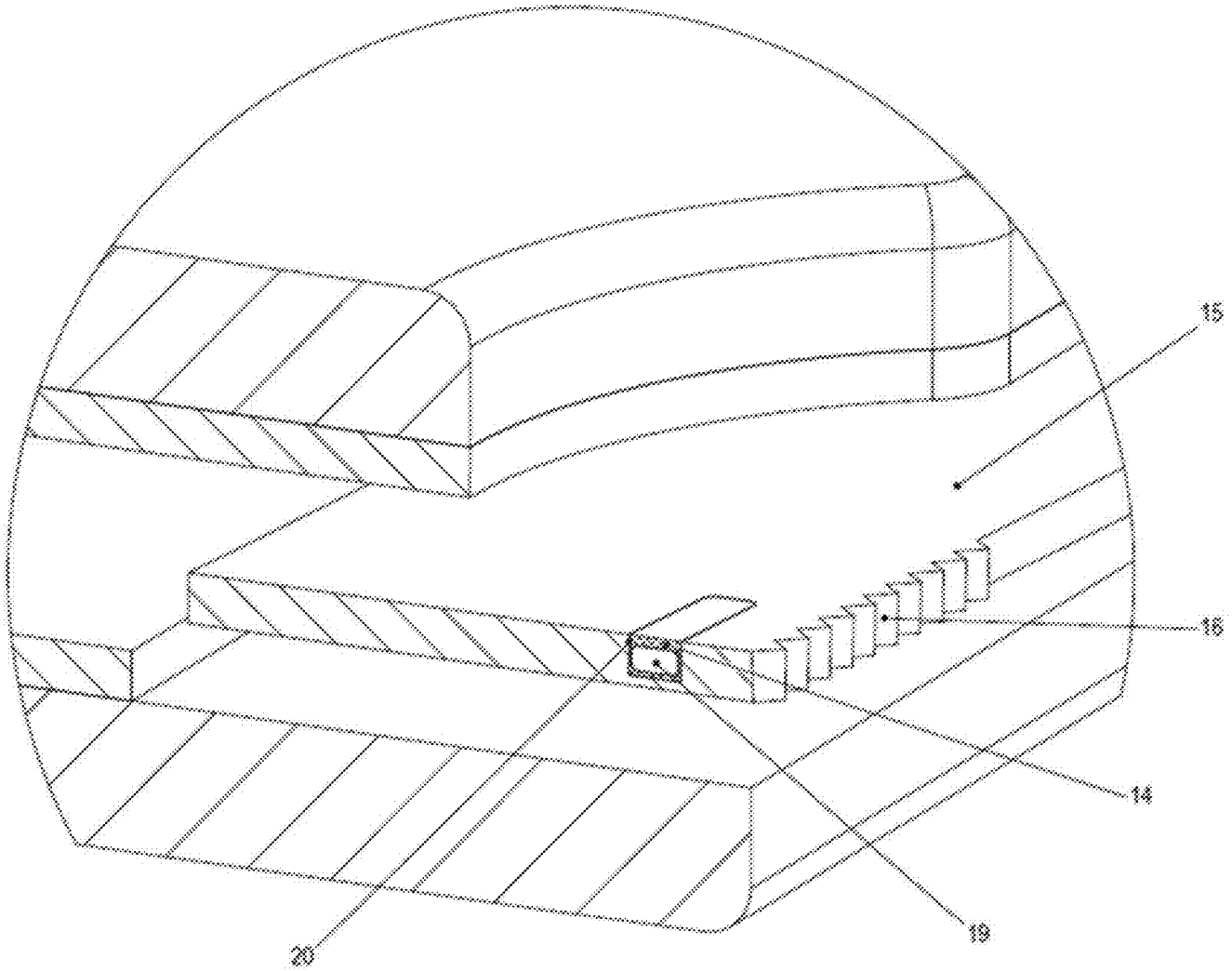
FIG. 10 is a cross-sectional view of the folding knife of FIG. 3 with a GTLS positioned in a recess at an actuation portion of a liner lock feature.

Referring again to the liner lock embodiment of the folding knife shown in FIGS. 3 and 4, the liner lock 15 may be actuated by a user pressing the actuation portion 16 in a lateral or sideways direction relative to the side plates 3. Applying this actuation force may move the liner lock 15 out of locked engagement with the blade 1 to permit the blade to rotate from the fully opened/locked position shown in FIG. 4 to an unlocked position. Since the liner lock 15 is typically thinner than the backlock 2 of the embodiment shown in FIGS. 1 and 2, the liner lock 15 typically may be operated from a side or a lateral direction. Integration of a GTLS into the liner lock pocketknife of FIGS. 3 and 4 typically includes positioning the GTLS so that it is visible on the pocketknife from a side or lateral direction. The GTLS may be positioned on the liner lock 15 as shown in FIG. 10, such as along a side surface of the liner lock 15. In at least one example, a recess 20 is formed in a side surface of the liner lock 15, and a GTLS 19 is positioned within the recess. The GTLS 19 may be secured within the recess using, for example, a connecting feature such as an adhesive. A protective layer 14 may also be positioned within the recess 20 to provide protection and a physical boundary for the GTLS 19. The protective layer 14 may also act as a connecting feature (e.g., an adhesive). The protective layer 14 may comprise a translucent or a transparent material. As an alternative or in addition to the protective layer, a protective cover 26 may also be used in the recess 20. The protective cover 26 may comprise a translucent or a transparent material. Some example materials for the protective cover 26 may comprise, for example, plastic, glass, or sapphire.

In other embodiments, the recess 20 is provided as a breakthrough or pass-through opening that extends from one side of the liner lock 15 to an opposite side of the liner lock 15. The GTLS 19 may be visible from both sides of the liner lock 15. Preferably, the GTLS 19 is arranged such that it is visible along that side of the liner lock 15 that is aligned with a recess or cut out in the side plate 3 that provides easier user access to the actuation portion 16 of the liner lock 15.

Figure 11:
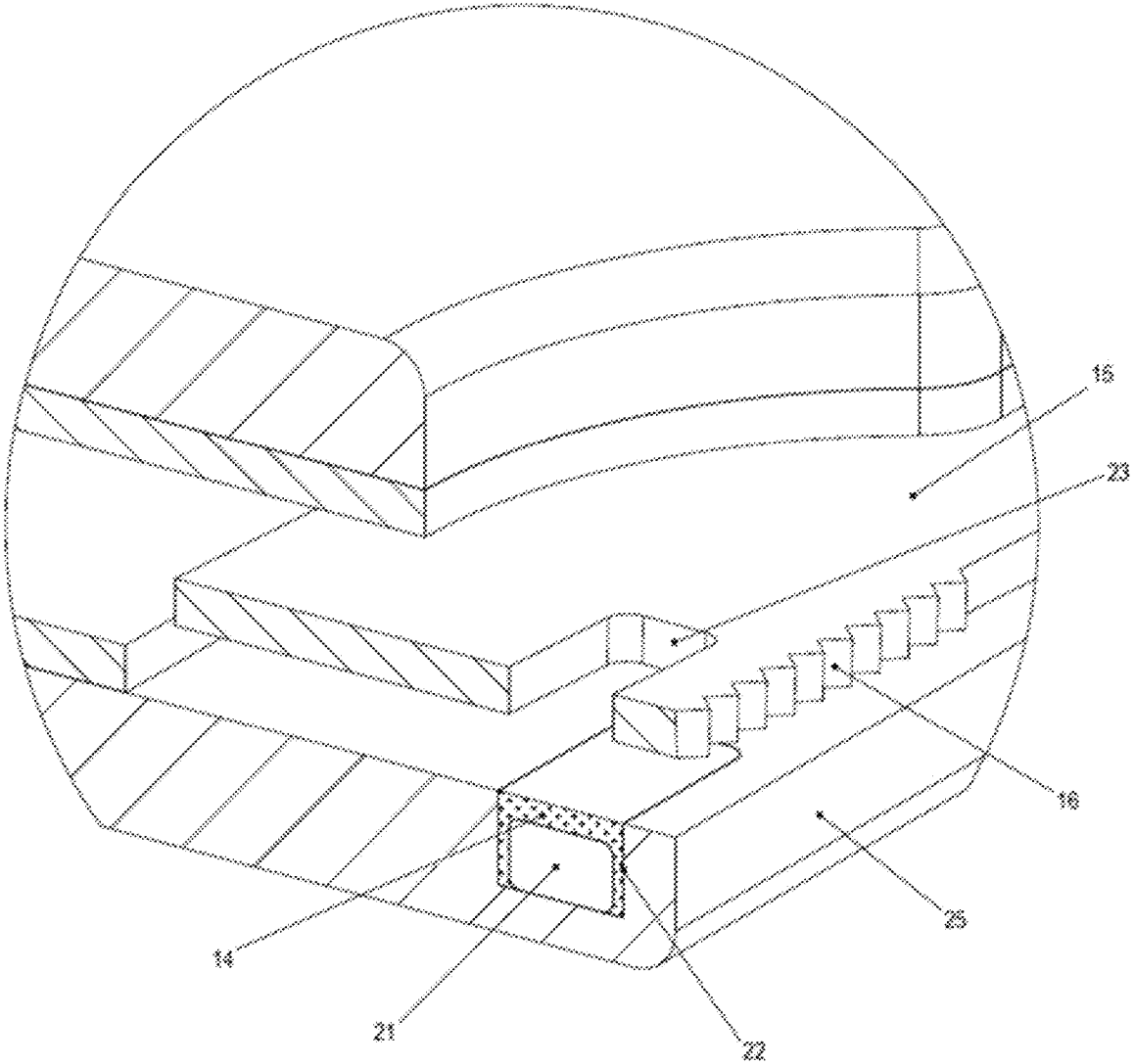
FIG. 11 is a cross-sectional view of the folding knife of FIG. 3 having a GTLS positioned in a recess in a knife part positioned behind or adjacent to an actuation portion of the liner lock, and an opening formed in the liner lock for visibility of the GTLS.

Referring to FIG. 11, another alternative design is shown for the liner lock version of the pocketknife shown in FIGS. 3 and 4. The embodiment of FIG. 11 includes a GTLS 21 positioned in the component of the pocketknife that is positioned adjacent to (i.e., behind) the liner lock 15. A recess 22 may be formed in the component adjacent to or behind the liner lock 15, and a separate GTLS 21 is positioned in the recess 22. A protective layer 14 may be positioned within the recess 22 to cover and/or protect the GTLS 21. The protective layer 14 may comprise a translucent or transparent material. The protective cover 14 may also provide a connection or bond to secure the GTLS 21 to the component. In some examples, a separate protective cover 26 may be used in place of or in addition to the protective layer 14. The liner lock 15 may include a cut-out or breakthrough feature 23 that passes completely through the liner lock 15 from one side to the other. The breakthrough 23 may provide a window or opening through which a user may see the GTLS 21 from at least one side of the pocketknife. Although the GTLS 21 is not positioned on the liner lock 15. The light is visible through the GTLS, thus, providing illumination in the area in which the user should apply a force to actuate the liner lock 15 from the locking position shown in FIG. 11 to an unlocked position out of engagement with the blade to permit the blade to move from the locked position (i.e., fully opened) to an unlocked position. The GTLS may illuminate a portion of the liner lock 15 such that the user can see that portion of the liner lock 15 to actuate.

Other embodiments may include the GTLS 21 positioned on other components such as a component on the front side rather than the back side of the liner lock 15. In one example, referring to FIG. 11, the GTLS 21 may be positioned on the component in front of or laterally adjacent to the liner lock 15 where the recess is formed for the users finger/thumb to gain access to the liner lock 15 to apply the lateral force. In still further embodiments, the GTLS 21 is positioned along a top side of the liner lock 15 (e.g., along the surface that includes the serrations shown in FIG. 11). In still further embodiments, multiple GTLS units 21 may be positioned at or on various components of the pocketknife, such as, for example, on components positioned on the front and back sides of the liner lock 15, on the liner lock and on one or more of the components positioned in front of, behind or otherwise adjacent to the liner lock 15, or multiple GTLS 21 positioned on any one or more of the components of the pocketknife, wherein the GTLS provide a visual indication to the user of the location of the actuation portion 16 of the liner lock 15.

Various methods of manufacturing and/or use of a pocketknife that includes an illumination feature are disclosed herein. An example manufacturing method many include providing an illumination feature on an actuation portion or adjacent to an actuation portion on a foldable pocketknife. The illumination feature may include, for example, a GTLS. Providing the illumination feature may include, for example, mounting the illumination feature directly to an actuation portion or a feature of the pocketknife adjacent to the actuation portion. The mounting may include, for example, embedding the illumination feature within a recess or a pass-through opening or breakthrough feature in the actuation portion or component adjacent to the actuation portion. The illumination feature may include a plurality of illumination features, such as a plurality of GTLS members. A plurality of illumination features may be used on a single pocketknife to identify an actuation feature or other feature of the pocketknife such as a stop surface that engages with the blade of the pocketknife. In one example, mounting the illumination feature may include positioning an illumination feature on an end surface of a backlock member, wherein the illumination feature is covered from view when the blade is in a fully opened and locked position, and the illumination feature is visible to a user when the blade is in an unlocked, not fully opened position.

Providing the illumination feature may include at least partially covering the illumination feature with a protective layer and/or protective cover. The illumination feature may include a light generating device such as a GTLS. The light generating device may be encapsulated or enclosed within a protective layer and/or protective cover and provided as a self-contained unit. In other arrangements, the providing of an illumination feature may include positioning a light generating member within or on a component of the pocketknife, and in a further manufacturing step, enclosing the light generating member within a protective layer, a mounting component such as an adhesive, or a protective cover, or the like.

A further manufacturing step may include forming a pass-through opening, breakthrough, or window within an actuation feature of the pocketknife, wherein the opening provides a visual path for a user to see an illumination feature through the actuating member so the user knows where to apply a force to actuate the actuating member.

Many other methods related to manufacturing, assembly, operating and adjusting a knife, and particularly a pocketknife with a foldable blade, having at least one permanent light feature such as a GTLS. The methods disclosed herein may be carried out using the various embodiments and functionality disclosed herein. This methods are exemplary only and may include more or fewer steps in other embodiments.

The folding knife and related methods of operation disclosed herein may provide a number of advantages over existing folding knifes. For example, folding knifes disclosed herein may provide, among other things, the following advantages:

A user can find the knife in low light conditions because the permanent light feature or features of the knife are visible regardless of the lighting conditions, and particularly low light conditions.

Increased overall safety related to operating and/or using the knife, particularly related to opening and/or closing of the knife in low light conditions.

Increased overall safety related to operating and/or using the knife, particularly related to operation of the knife by providing a visual indication to the user that the blade is locked or unlocked (i.e., in a fully open or partially open position).

The description set forth herein, in connection with the appended drawings, describes example configurations and does not represent all the examples that may be implemented or that are within the scope of the claims. The term "exemplary" used herein means "serving as an example, instance, or illustration," and not "preferred" or "advantageous over other examples." The detailed description includes specific details for the purpose of providing an understanding of the described techniques. These techniques, however, may be practiced without these specific details. In some instances, well-known structures and devices are shown in block diagram form in order to avoid obscuring the concepts of the described examples.

In the appended figures, similar components or features may have the same reference label. Further, various components of the same type may be distinguished by following the reference label by a dash and a second label that distinguishes among the similar components. If just the first reference label is used in the specification, the description is applicable to any one of the similar components having the same first reference label irrespective of the second reference label.

Features implementing functions may also be physically located at various positions, including being distributed such that portions of functions are implemented at different physical locations. Also, as used herein, including in the claims, "or" as used in a list of items (for example, a list of items prefaced by a phrase such as "at least one of" or "one or more of") indicates an inclusive list such that, for example, a list of at least one of A, B, or C means A or B or C or AB or AC or BC or ABC (i.e., A and B and C). Also, as used herein, the phrase "based on" shall not be construed as a reference to a closed set of conditions. For example, an exemplary step that is described as "based on condition A" may be based on both a condition A and a condition B without departing from the scope of the present disclosure. In other words, as used herein, the phrase "based on" shall be construed in the same manner as the phrase "based at least in part on."

The description herein is provided to enable a person skilled in the art to make or use the disclosure. Various modifications to the disclosure will be readily apparent to those skilled in the art, and the generic principles defined herein may be applied to other variations without departing from the scope of the disclosure. Thus, the disclosure is not limited to the examples and designs described herein, but is to be accorded the broadest scope consistent with the principles and novel features disclosed herein.

What is claimed is:

1. A folding knife comprising:

a handle assembly;

a blade pivotally connected to the handle assembly;

at least one of a liner lock or backlock member actuatable to lock and unlock the blade relative to the handle assembly, or a blade stop member;

at least one Gaseous Tritium Light Source (GTLS) carried by the liner lock or backlock member, positioned adjacent to the liner lock or backlock member, or carried by the blade stop member.

2. The folding knife of claim 1, wherein the at least one GTLS is attached to an actuating portion of the liner lock or backlock member.

3. The folding knife of claim 1, wherein the at least one GTLS is carried by the liner lock or backlock member or positioned adjacent to the liner lock or backlock member, and another GTLS is carried by the blade stop member.

4. The folding knife of claim 1, wherein the liner lock member is a liner lock lever, and the at least one GTLS is attached to an actuation portion of the liner lock lever.

5. The folding knife of claim 1, wherein the at least one GTLS is positioned adjacent to the liner lock or backlock member.

6. The folding knife of claim 1, wherein the backlock member includes a backlock lever, and the at least one GTLS is attached to an actuation portion of the backlock lever.

7. The folding knife of claim 1, wherein the at least one GTLS is positioned in a recess formed in the liner lock or backlock member, or in a recess formed in the blade stop member.

8. The folding knife of claim 7, wherein the recess is designed as a groove, a bore, a breakthrough, or a cavity.

9. The folding knife of claim 1, wherein the at least one GTLS is visible from at least two sides of the knife.

10. The folding knife of claim 1, further comprising a breakthrough formed in the liner lock, the at least one GTLS is positioned adjacent to the liner lock, and the at least one GTLS is visible through the breakthrough.

11. The folding knife of claim 1, wherein the at least one GTLS is secured directly to or is part of a GTLS assembly that is secured to the liner lock or backlock member or the blade stop member.

12. The folding knife of claim 1, wherein the at least one GTLS is part of a GTLS assembly that includes a transparent or partially transparent container, wherein the transparent or partially transparent container comprises at least one transparent solid component such as sapphire, glass, or plastic in any shape.

13. A method of manufacturing a folding knife, the method comprising:

providing a handle assembly, a blade, at least one Gaseous Tritium Light Source (GTLS), and at least one of a liner lock or backlock member or a blade stop;

pivotally connecting the blade to the handle assembly;

mounting the at least one of the liner lock or backlock member or the blade stop to the handle;

mounting the at least one GTLS to the at least one of the liner lock or backlock member or the blade stop.

14. The method of claim 13, wherein the backlock or liner lock member includes a backlock lever or liner lock lever, and the at least one GTLS is mounted to or adjacent to an actuation portion of the backlock lever or liner lock lever.

15. The method of claim 14, wherein mounting the at least one GTLS includes covering the at least one GTLS with a protective covering.

* * * * *